US007234449B2

(12) United States Patent
Casabianca et al.

(10) Patent No.: US 7,234,449 B2
(45) Date of Patent: Jun. 26, 2007

(54) COMMON FUEL RAIL FUEL SYSTEM FOR LOCOMOTIVE ENGINE

(75) Inventors: Jose M. Casabianca, Erie, PA (US); Shawn Michael Gallagher, Erie, PA (US); Eric Richard Dillen, Erie, PA (US)

(73) Assignee: General Electric Company, Schenectady, NY (US)

( * ) Notice: Subject to any disclaimer, the term of this patent is extended or adjusted under 35 U.S.C. 154(b) by 139 days.

(21) Appl. No.: 11/181,655

(22) Filed: Jul. 14, 2005

(65) Prior Publication Data

US 2007/0012294 A1 Jan. 18, 2007

(51) Int. Cl.
*F02M 69/46* (2006.01)
*F02M 69/50* (2006.01)

(52) U.S. Cl. ..... 123/456; 123/446

(58) Field of Classification Search ..... 123/456, 123/495, 447, 446; 417/439, 490, 493
See application file for complete search history.

(56) References Cited

U.S. PATENT DOCUMENTS 4,142,497 A * 3/1979 Long ..... 123/456
4,674,448 A * 6/1987 Steiger ..... 123/23
4,989,568 A * 2/1991 Sougawa ..... 123/456
5,133,645 A * 7/1992 Crowley et al. ..... 417/279
5,197,438 A 3/1993 Kumano et al.
5,201,294 A 4/1993 Osuka
5,230,613 A 7/1993 Hilsbos et al.
5,277,156 A 1/1994 Osuka et al.
5,313,924 A 5/1994 Regueiro
5,365,902 A 11/1994 Hsu
5,394,851 A 3/1995 Cryer et al.
5,433,182 A * 7/1995 Augustin et al. ..... 123/456
5,492,099 A 2/1996 Maddock
5,605,134 A 2/1997 Martin
5,697,341 A * 12/1997 Ausman et al. ..... 123/446

(Continued)

OTHER PUBLICATIONS

Automotive Equipment: Diesel injection technology. Common rail from Bosch for vehicles used in the construction industry and in agriculture. http://www.bosch-presse.de.

*Primary Examiner*—Mahmoud Gimie
(74) *Attorney, Agent, or Firm*—Carlos Luis Hanze; David G. Maire; Beusse Wolter Sanks Mora & Maire, P.A.

(57) ABSTRACT

A common rail fuel injection apparatus (1) for a multi-bank, diesel locomotive engine (10). A common rail (20,22) is disposed proximate each bank (20,22) of cylinders (12) of the engine to provide high pressure fuel (30) to a fuel flow control apparatus (14) associated with each respective cylinder. A plurality of high-pressure fuel pumps (34) provides high-pressure fuel to at least one of the common rails. A fluid cross connection (38) is provided to convey high pressure fuel between the two common rails, thereby providing for the continued delivery of fuel to all cylinders in the event of a failure of one of the high pressure pumps. The high-pressure pumps are motivated by fuel lobes (64) located on camshaft sections (50*a*, 50*b*, 50*c*) adjoined at a gear driven end 58 of the camshaft (50). Camshaft sections (50*d*, 50*e*, 50*f*) adjoined at an idler end (60) of the camshaft carry lower torque loads than those sections having fuel lobes and may be formed from a lower strength material or may have a smaller shaft diameter.

19 Claims, 2 Drawing Sheets

U.S. PATENT DOCUMENTS 5,975,056 A * 11/1999 Augustin et al. ..... 123/478
6,000,380 A * 12/1999 Weisbarth ..... 123/456
6,016,791 A 1/2000 Thomas et al.
6,192,863 B1 2/2001 Takase
6,349,706 B1 2/2002 Hsu et al.
6,357,421 B1 3/2002 Pritchard
6,450,146 B1 * 9/2002 Dickerson et al. ..... 123/446
6,584,953 B2 7/2003 Yomogida
6,601,564 B2 * 8/2003 Davey ..... 123/456
6,647,938 B2 * 11/2003 Gaessler et al. ..... 123/179.17
6,712,045 B1 3/2004 McCarthy, Jr.
6,823,844 B2 * 11/2004 Steinbrenner et al. ..... 123/446
6,848,414 B2 2/2005 West et al.
6,932,583 B2 * 8/2005 Niethammer ..... 417/286
2002/0162536 A1 * 11/2002 Steinbrenner et al. ..... 123/446

* cited by examiner

COMMON FUEL RAIL FUEL SYSTEM FOR LOCOMOTIVE ENGINE

FIELD OF THE INVENTIONS

This specification relates generally to the field of railroad locomotives and more generally to a common rail fuel system for a diesel engine of a railroad locomotive.

BACKGROUND OF THE INVENTIONS

Fuel injection systems are widely used on internal combustion engines, including spark ignition engines and compression ignition (diesel) engines for automobiles, trucks, marine and stationary engines. One such fuel injection system is described in U.S. Pat. No. 6,357,421. A common rail fuel system utilizes a fuel accumulator (rail) that is maintained at a high pressure (typically 1,600-2,000 bar) by one or more high-pressure fuel pumps. The fuel injectors associated with cylinders of the engine receive fuel from the fuel rail, with the delivery of the fuel being controlled by a solenoid valve disposed between the fuel rail and the injection nozzle.

U.S. Pat. No. 5,394,851 describes a fuel injection system commonly used on the large displacement, turbocharged, medium speed diesel engines of railroad locomotives provided by the present assignee. Such engines include a plurality of unitized power assemblies each containing a cylinder, a cylinder head, cam-driven intake and exhaust valves, and a fuel injection system including a fuel pump, a fuel injection control solenoid and a fuel injection nozzle. Each fuel pump is driven by a fuel lobe located on the respective camshaft of the engine.

DETAILED DESCRIPTION OF THE INVENTION

The present inventors have recognized certain benefits associated with utilizing a high-pressure common rail fuel system for fuel delivery to a multi-cylinder diesel engine in a locomotive application. Such benefits result from the ability to control fuel delivery to each cylinder with more precision and flexibility than is possible with other systems. However, the present inventors have also recognized certain limitations of prior art common rail fuel systems that are particularly problematic for locomotive applications. For example, a fuel rail is normally positioned close to its associated cylinders in order to minimize fuel pressure fluctuations at the fuel injection nozzles. For engines containing two banks of cylinders, such as are common for locomotive applications, two separate rails are typically provided to supply fuel independently to the two banks of cylinders, such as is illustrated in U.S. Pat. No. 5,133,645. In the event of a failure of the fuel supply to either of the two rails, half of the cylinders of such an engine become inoperative, which has not been recognized as a significant problem in prior art truck applications. However, the application of known common rail fuel systems to a locomotive application would leave the locomotive vulnerable to a failure mode that could disable a train due to the inability of the engine to provide enough motive force to keep the train moving along an inclined track. Such a failure mode is highly undesirable in the rail industry.

Figure 1:
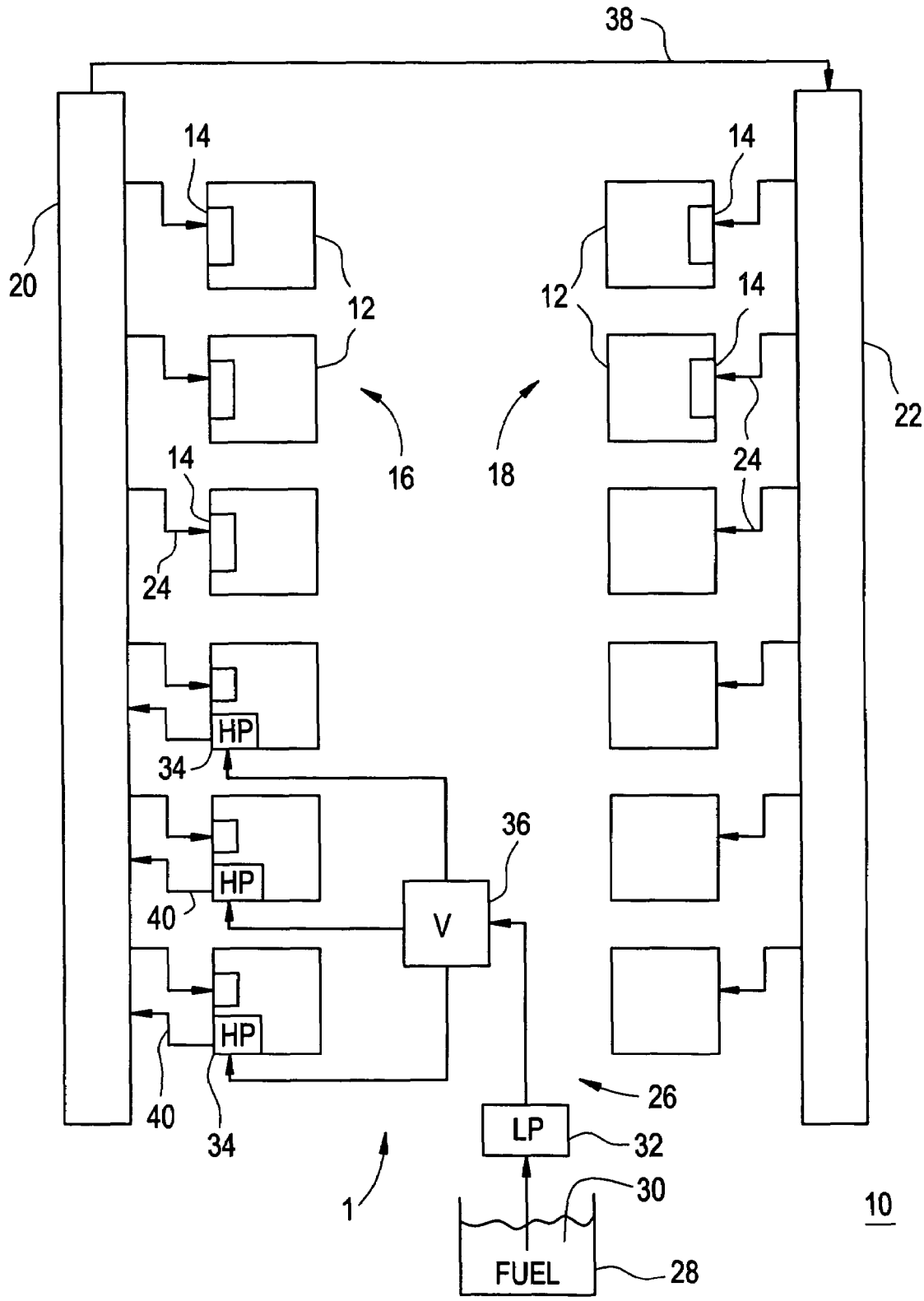
FIG. 1 is a schematic illustration of a multi-cylinder diesel locomotive engine incorporating a common rail fuel injection apparatus.

FIG. 1 illustrates an improved fuel injection apparatus 1 that facilitates the exploitation of the benefits of common rail fueling technology in a multi-bank, multi-cylinder, diesel locomotive engine application. FIG. 1 is a schematic illustration of a locomotive engine 10 including twelve cylinders 12. Each cylinder 12 may be part of a power assembly that includes the cylinder, a cylinder head, a piston, intake and exhaust valves, and a fuel flow control apparatus 14. The fuel flow control apparatus 14 may include a fuel injection nozzle and a solenoid valve controlling the delivery of fuel to the fuel injection nozzle. The cylinders 12 are grouped into a left bank 16 and a right bank 18. The terms left bank and right bank are commonly used in the art as an engine naming convention and should not be construed herein as being limiting.

A fuel injection apparatus left bank common fuel rail 20 is disposed proximate the left bank of cylinders 16 and a right bank common fuel rail 22 is disposed proximate the right bank of cylinders 18. The rails 20, 22 are advantageously located as close to the cylinders 12 as practical so that high pressure fuel supply lines 24 delivering high pressure fuel from the respective rail 20, 22 to the flow control apparatus 14 are kept as short as practical. A low pressure fuel supply 26 includes a fuel tank 28 containing a supply of fuel 30, and a low pressure fuel pump 32 delivering the fuel 30 from the tank 28 to one or more high pressure fuel pumps 34 through a flow metering valve 36. The pressure in the fuel rails 20, 22 is maintained within a desired pressure range by controlling the delivery of fuel 30 through valve 36 using any known closed-loop control arrangement (not shown).

Advantageously, a fluid cross connection 38 is provided for the conveyance of fuel 30 between the left bank common rail 20 and the right bank common rail 22. While other arrangements may be envisioned in other embodiments, the three high-pressure pumps 34 of FIG. 1 are all disposed proximate the left common rail 20 and are connected to provide fuel to the left common rail 20 via high pressure supply lines 40. One skilled in the art may appreciate that one or more such high pressure pumps 34 may be provided in other applications to deliver fuel 30 to the right common rail 22. For example, in one V-16 diesel engine application, two high pressure fuel pumps may be used to provide fuel to the left rail and two high pressure fuel pumps may be used to provide fuel to the right rail. In the embodiment of FIG. 1, high pressure fuel is provided from the left common rail 20 to the right common rail 22 via the cross connection 38. Other embodiments may have more than one fluid cross connection between the fuel rails such as may be desired to optimize the mechanical and fluid design of the fuel injection apparatus 1. The plurality of high pressure pumps 34 and the fluid cross connection 38 cooperate to enable delivery of fuel 30 for continued operation of all of the cylinders 12 in the event of a failure of one of the high pressure pumps 34. The location of the cross connection 38 is illustrated schematically in FIG. 1, and one skilled in the art may appreciate that it may be located closer to the high pressure pumps 34 in other embodiments.

The fuel injection apparatus 1 of FIG. 1 may be designed to provide for continued full power operation, or a selected reduced power level of operation with one of the high-pressure pumps 34 being inoperative. The fluid capacity of the each high pressure pump 34 may be selected to be approximately 50% of the total engine fuel flow requirement at full power operation, for example. In this manner, should one of the three high pressure fuel pumps 34 fail, the remaining two operating pumps 34 remain capable of providing full fuel flow to all cylinders 12 at full power operating conditions. Because of the functionality of the cross connection 38, this capability exists with the high pressure pumps 34 all providing fuel into only the left rail 20, as illustrated, or in other embodiments where one, two or three of the high pressure pumps 34 provide fuel 30 into the right rail 22.

The fuel injection apparatus 1 of FIG. 1 may be installed as original equipment on a new engine 10, or it may be back-fitted into an existing engine that originally utilized a fuel injection apparatus such as illustrated in U.S. Pat. No. 5,394,851. Such prior art systems include a cam-driven mechanical fuel pump mounted onto the strongback (mounting bracket) of each power assembly unit of the engine. When modifying such a twelve-cylinder engine to include the improved fuel injection apparatus 1 of FIG. 1, the twelve original fuel pumps are removed and the three high-pressure fuel pumps 34 are mounted onto the respective strongbacks in the place of three of the original pumps. Openings through the strongbacks that do not receive a high-pressure pump 34 may need to be sealed. For a bank of cylinders 12 where the high-pressure pumps 34 are installed, such as the left bank 16 of FIG. 1, a change in camshaft design may be required. Some of the original cam sections may be used in the modified engine. The present inventors have innovatively exploited the need for a change in camshaft design to further extend the advantages of the present fuel injection apparatus 1, as described more fully in the following paragraphs with reference made to FIG. 2.

Figure 2:
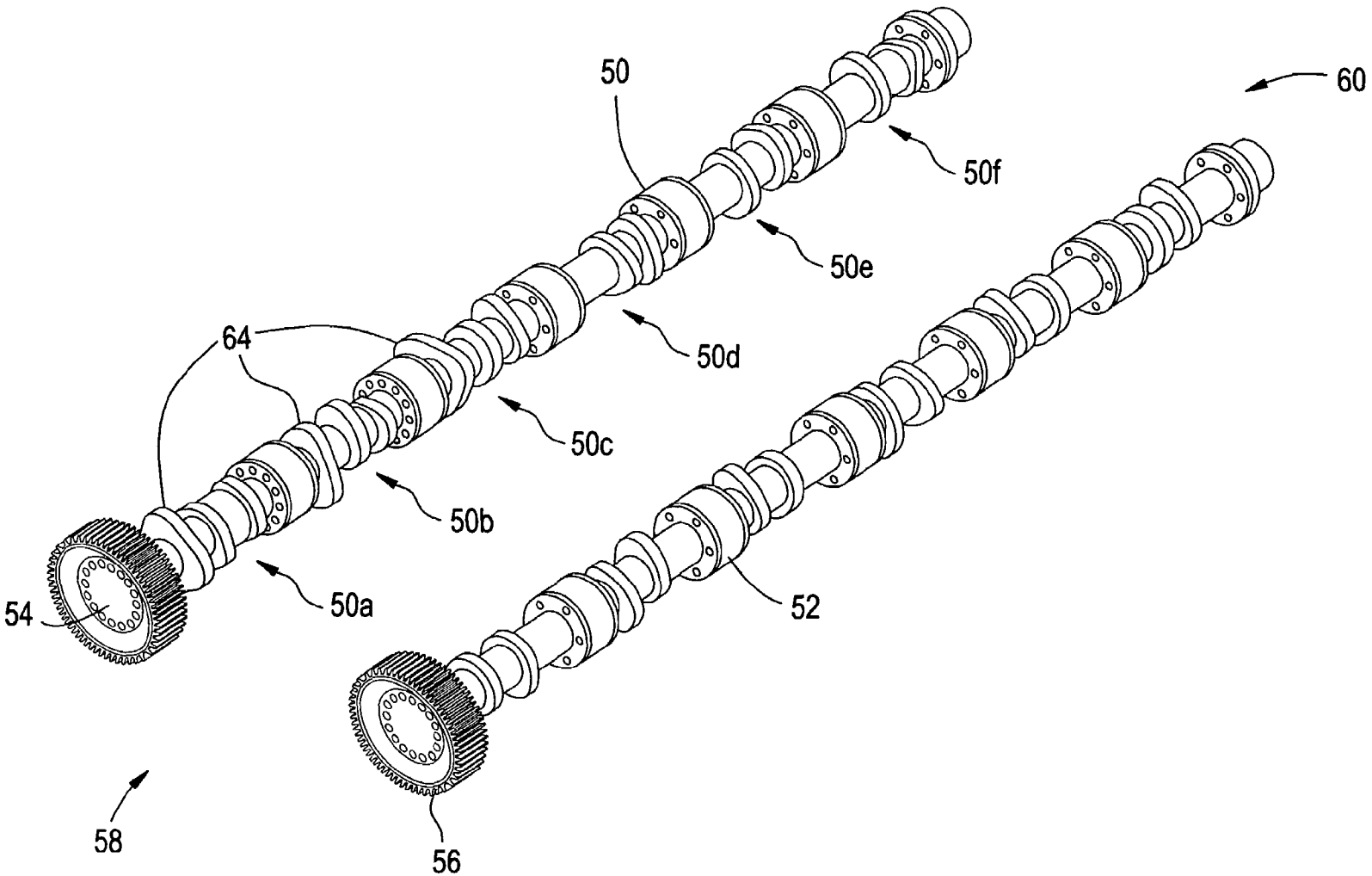
FIG. 2 is a perspective illustration of the camshafts used in the engine of FIG. 1.

FIG. 2 is a perspective view of camshafts 50, 52 as may be used in one embodiment of the engine 10 of FIG. 1. Left camshaft 50 is used in conjunction with the left bank 16 of cylinders 12 and right camshaft 52 is used in conjunction with the right bank 18 of cylinders 12. Each camshaft 50, 52 includes a drive gear 54, 56 at a driven end 58 and an opposed idler end 60. Torque is transferred from the drive gears 54, 56 to provide mechanical energy to respective valve lobes 62 for motivating the intake and exhaust valves (not shown) of each power assembly. Torque is also transferred from drive gear 54 to provide mechanical energy to respective fuel lobes 64 for powering the respective high-pressure fuel pumps 34. The camshafts 50, 52 are assembled by joining a plurality of cam sections, with each cam section being associated with one cylinder 12/power assembly of the engine 10. Left camshaft 50 includes cam sections 50*a*, 50*b*, 50*c*, 50*d*, 50*e* and 50*f*. Every cam section includes valve lobes 62 for the intake and exhaust valves of the respective power assembly. The cam sections alternatively include a fuel lobe 64 or do not include a fuel lobe 64. Cam sections 50*a*, 50*b* and 50*c* of FIG. 1 include fuel lobes 64. The lobes 64 may be angularly displaced relative to each other, such as by 40 degrees in one embodiment, in order to provide a more constant fuel supply pressure to the fuel rail 20. Advantageously, each of the sections 50*a*, 50*b* and 50*c* including a fuel lobe 64 are located proximate the driven end 58 of the camshaft 50, and no cam section that does not include a fuel lobe is located between the drive gear 54 and any section(s) including a fuel lobe 64. Thus, the adjoined sections most proximate the gear driven end 58 of the camshaft 50 may include a fuel lobe 64 and the adjoined sections most remote from the gear driven end 58 do not include a fuel lobe 64. In this manner, a torque value transmitted through the sections 50*d*, 50*e*, 50*f* not including a fuel lobe 64 is less than the torque value transmitted through the camshaft sections 50*a*, 50*b*, 50*c* that include a fuel lobe 64. This allows the camshaft sections not including a fuel lobe to be designed to have a smaller load-carrying capability than the section that include a fuel lobe. This may be accomplished by designing them with a smaller shaft diameter or by utilizing a material having a strength value (such as tensile or shear strength, for examples) lower than a corresponding strength value of a material of the camshaft sections including a fuel lobe. Thus, the cost of manufacturing camshaft sections not including a fuel lobe may be lower than the cost of manufacturing sections that do include a fuel lobe and/or lower than the cost of a prior art camshaft section that does include a fuel lobe. For a back-fit application utilizing the embodiment of FIG. 1, the original right camshaft may be left in place, and only the cam sections of the left camshaft that are associated with pumps need be replaced to assemble the camshaft 50 of FIG. 2. The replacement camshaft may be a completely new unit or it may be assembled using sections of the replaced camshaft.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A fuel injection apparatus for a multi-cylinder diesel locomotive engine comprising a left bank of cylinders and a right bank of cylinders, the fuel injection apparatus comprising:

a left bank common rail disposed proximate the left bank of cylinders;

a right bank common rail disposed proximate the right bank of cylinders;

a low pressure fuel supply;

a plurality of high pressure fuel pumps receiving low pressure fuel from the low pressure fuel supply and providing high pressure fuel to at least one of the left bank common rail and the right bank common rail;

a fluid cross connection for conveyance of fuel between the left bank common rail and the right bank common rail;

each left bank cylinder receiving fuel from the left bank common rail via a respective fuel injection control apparatus; and each right bank cylinder receiving fuel from the right bank common rail via a respective fuel injection control apparatus;

the plurality of high pressure pumps and the fluid cross connection cooperating to enable delivery of full fuel flow for continued operation of all of the cylinders at full power operating conditions in the event of a failure of one of the high pressure pumps.

2. The fuel injection apparatus of claim 1, further comprising:

a camshaft associated with each bank of cylinders, each camshaft comprising a plurality of adjoined sections, the adjoined sections extending from a gear driven end to an opposed idler end of the respective camshaft, each camshaft section alternatively comprising or not comprising a fuel lobe;

each of the high pressure pumps being motivated by a respective fuel lobe disposed on a respective one of the camshaft sections;

a camshaft section comprising a fuel lobe being disposed proximate the gear driven end of the respective camshaft and a camshaft section not comprising a fuel lobe being disposed proximate the idler end of that respective camshaft, so that a torque value transmitted through the camshaft section not comprising a fuel lobe is less than a torque value transmitted through the camshaft section comprising a fuel lobe.

3. The fuel injection apparatus of claim 2, further comprising the camshaft section not comprising a fuel lobe comprising a shaft diameter smaller than a shaft diameter of the camshaft section comprising a fuel lobe.

4. The fuel injection apparatus of claim 2, further comprising the camshaft section not comprising a fuel lobe comprising a material exhibiting a strength value lower than a corresponding strength value of a material of the camshaft section comprising a fuel lobe.

5. The fuel injection apparatus of claim 2, further comprising all of the camshaft sections comprising a fuel lobe being adjoined proximate the gear driven end of a first of the camshafts, and a second of the camshafts not comprising a camshaft section comprising a fuel lobe.

6. The fuel injection apparatus of claim 1 as utilized on a diesel locomotive engine comprising six left bank cylinders and six right bank cylinders, the fuel injection apparatus further comprising:

three high pressure pumps receiving low pressure fuel from the low pressure fuel supply and providing high pressure fuel to the at least one of the left bank common rail and the right bank common rail; and the three high pressure pumps sized so that any two of the high pressure pumps are capable of maintaining the engine at full power in the event of a failure of a third high pressure pump.

7. The fuel injection apparatus of claim 6, further comprising:

a first camshaft associated with a first of the left and right bank of cylinders comprising six adjoined sections extending from a gear driven end of the first camshaft to an opposed idler end of the first camshaft; the three adjoined sections most proximate the gear driven end of the first camshaft each comprising a fuel lobe and the three adjoined sections most remote from the gear driven end of the first camshaft not comprising a fuel lobe; and a second camshaft associated with a second of the left and right bank of cylinders comprising six adjoined sections extending from a gear driven end of the second camshaft to an opposed idler end of the second camshaft, the sections of the second camshaft not comprising a fuel lobe.

8. The fuel injection apparatus of claim 6, further comprising the camshaft sections not comprising a fuel lobe comprising a shaft diameter smaller than a shaft diameter of the camshaft sections comprising a fuel lobe.

9. The fuel injection apparatus of claim 6, further comprising the camshaft sections not comprising a fuel lobe comprising a material exhibiting a strength value less than a corresponding strength value of a material of the camshaft sections comprising a fuel lobe.

10. An internal combustion engine comprising:

a first bank of cylinders;

a second bank of cylinders;

a first common rail disposed proximate the first bank of cylinders;

a second common rail disposed proximate the second bank of cylinders;

a low pressure fuel supply;

a plurality of high pressure fuel pumps receiving low pressure fuel from the low pressure fuel supply and providing high pressure fuel to at least one of the first common rail and the second common rail;

a fuel flow control apparatus associated with each cylinder of the first bank for controlling a flow of fuel from the first common rail to the respective cylinder of the first bank;

a fuel flow control apparatus associated with each cylinder of the second bank for controlling a flow of fuel from the second common rail to the respective cylinder of the second bank; and a fluid cross connection for conveyance of fuel between the first common rail and the second common rail;

further comprising all of the high pressure pumps delivering fuel to the first common rail and the fluid cross connection delivering fuel from the first common rail to the second common rail.

11. The engine of claim 10, further comprising:

a first camshaft comprising a plurality of adjoined sections extending from a driven end to an idler end associated with the first bank of cylinders;

a second camshaft comprising a plurality of adjoined sections extending from a driven end to an idler end associated with the second bank of cylinders;

a first group of the sections each comprising a fuel lobe for motivating a respective high pressure pump and each transferring a first value of torque;

a second group of the sections not comprising a fuel lobe and each transferring a second value of torque less than the first value of torque.

12. The engine of claim 11, wherein the sections of the second group each comprise a shaft diameter smaller than a shaft diameter of the sections of the first group.

13. The engine of claim 11, wherein the sections of the second group each comprise a material exhibiting a strength value lower than a corresponding strength value of the sections of the first group.

14. A method of retrofitting a multi-bank, multi-cylinder, diesel locomotive engine to use a common rail fuel apparatus, the method comprising:

installing a common rail proximate each bank of the engine;

installing at least one high pressure fuel pump for delivery of high pressure fuel to a first of the rails;

installing a fluid cross connection between the rails for delivery of high pressure fuel from the first of the rails to a second of the rails;

delivering high pressure fuel to a fuel injection control apparatus associated with each respective cylinder of the engine from the common rail proximate the respective bank of cylinders.

15. The method of claim 14, further comprising:

providing a plurality of high pressure fuel pumps for delivery of high pressure fuel to at least one of the rails;

selecting a capacity of each of the plurality of high pressure fuel pumps so that the engine is capable of producing a selected power level by providing fuel to all of the cylinders with one of the plurality of high pressure fuel pumps being inoperative.

16. The method of claim 15, further comprising:

mounting all of the high pressure fuel pumps proximate one bank of cylinders;

replacing one of two original camshafts of the engine with a replacement camshaft comprising adjoined sections at a driven end each comprising a fuel lobe for motivating a respective one of the high pressure fuel pumps; and not replacing a second of the two original camshafts.

17. The method of claim 14, further comprising replacing an original camshaft of the engine with a replacement camshaft comprising a first section at a driven end comprising a fuel lobe for motivating the high pressure fuel pump.

18. The method of claim 16, further comprising forming the replacement camshaft with the first section comprising a first shaft diameter at the driven end and a second shaft section comprising a second shaft diameter smaller than the first shaft diameter at an idler end opposed the driven end.

19. The method of claim 16, further comprising forming the replacement camshaft with the first section comprising a first material exhibiting a first strength value at the driven end and a second shaft section comprising a second material exhibiting a second strength value smaller than the first strength value at an idler end opposed the driven end.

* * * * *